US008922425B2

(12) United States Patent
Hayata

(10) Patent No.: US 8,922,425 B2
(45) Date of Patent: Dec. 30, 2014

(54) WAVEGUIDE STRUCTURE, HIGH FREQUENCY MODULE INCLUDING WAVEGUIDE STRUCTURE, AND RADAR APPARATUS

(75) Inventor: Kazuki Hayata, Soraku-gun (JP)

(73) Assignee: Kyocera Corporation, Kyoto (JP)

( * ) Notice: Subject to any disclaimer, the term of this patent is extended or adjusted under 35 U.S.C. 154(b) by 657 days.

(21) Appl. No.: 13/259,105

(22) PCT Filed: Mar. 31, 2010

(86) PCT No.: PCT/JP2010/055968

§ 371 (c)(1),
(2), (4) Date: Sep. 22, 2011

(87) PCT Pub. No.: WO2010/114078

PCT Pub. Date: Oct. 7, 2010

(65) Prior Publication Data

US 2012/0013421 A1 Jan. 19, 2012

(30) Foreign Application Priority Data

Mar. 31, 2009 (JP) ..... 2009-088205

(51) Int. Cl.

| | |
|---|---|
| ***H01Q 11/02*** | (2006.01) |
| ***H01Q 3/00*** | (2006.01) |
| ***H01Q 13/10*** | (2006.01) |
| ***H01Q 13/00*** | (2006.01) |
| ***H01Q 1/22*** | (2006.01) |
| ***H01P 5/107*** | (2006.01) |
| ***H01P 3/12*** | (2006.01) |
| ***H01P 5/02*** | (2006.01) |

(52) U.S. Cl.

CPC *H01P 5/107* (2013.01); *H01P 3/12* (2013.01); *H01P 5/02* (2013.01)

USPC ..... 342/175; 343/731; 343/762; 343/771; 343/772; 343/884

(58) Field of Classification Search

USPC ..... 342/175; 343/731, 762, 771, 772, 884

See application file for complete search history.

(56) References Cited

U.S. PATENT DOCUMENTS 2,619,539 A * 11/1952 Fano ..... 333/21 R
2,851,681 A * 9/1958 Cohn ..... 342/188

(Continued)

FOREIGN PATENT DOCUMENTS

JP 09-199901 7/1997
JP 2003-209411 7/2003

(Continued)

OTHER PUBLICATIONS

Japanese language office action dated Feb. 26, 2013 and its English language translation issued in corresponding Japanese application 2011507281.

(Continued)

*Primary Examiner* — Peter Bythrow

(74) *Attorney, Agent, or Firm* — Volpe and Koenig, P.C.

(57) ABSTRACT

A waveguide structure according to one embodiment includes an upper waveguide and a mode conversion portion. The upper waveguide internally transmits a high frequency signal in TE10 mode along a first direction. The mode conversion portion is configured to electromagnetically couple with the upper waveguide. The mode conversion portion converts the high frequency signal propagating through the upper waveguide from TE10 mode to TM11 mode. The mode conversion portion transmits the high frequency signal converted in a second direction perpendicular to the first direction. According to the waveguide structure pursuant to the embodiment, it is possible to attain excellent transmission characteristics of high frequency signals.

11 Claims, 11 Drawing Sheets

(56) References Cited

U.S. PATENT DOCUMENTS

| | | | | |
|---|---|---|---|---|
| 2,939,094 | A * | 5/1960 | Berk | 333/21 R |
| 3,001,193 | A * | 9/1961 | Marie | 342/365 |
| 3,646,481 | A * | 2/1972 | Den | 333/21 R |
| 4,167,715 | A * | 9/1979 | Ohm | 333/125 |
| 4,229,828 | A * | 10/1980 | Baird et al. | 455/326 |
| 4,476,470 | A * | 10/1984 | Bowman | 343/778 |
| 4,556,853 | A * | 12/1985 | Clark | 333/26 |
| 4,999,591 | A * | 3/1991 | Koslover et al. | 333/21 R |
| 5,399,999 | A * | 3/1995 | Eisenhart | 333/21 R |
| 5,467,064 | A * | 11/1995 | Gu | 333/128 |
| 5,757,252 | A * | 5/1998 | Cho et al. | 333/246 |
| 5,929,728 | A * | 7/1999 | Barnett et al. | 333/239 |
| 5,982,256 | A * | 11/1999 | Uchimura et al. | 333/239 |
| 6,154,176 | A * | 11/2000 | Fathy et al. | 343/700 MS |
| 6,556,099 | B2 * | 4/2003 | Khan et al. | 333/34 |
| 6,977,560 | B2 * | 12/2005 | Itoh et al. | 333/26 |
| 7,554,505 | B2 * | 6/2009 | Haziza | 343/786 |
| 8,159,316 | B2 * | 4/2012 | Miyazato et al. | 333/239 |
| 8,213,476 | B1 * | 7/2012 | Wanke et al. | 372/45.012 |
| 8,564,478 | B2 * | 10/2013 | Sagala et al. | 342/175 |
| 2003/0107459 | A1 | 6/2003 | Takahashi et al. | 333/230 |
| 2004/0085153 | A1 * | 5/2004 | Fukunaga | 333/33 |
| 2005/0219123 | A1 * | 10/2005 | Hansen et al. | 343/700 MS |
| 2007/0013581 | A1 * | 1/2007 | Iijima et al. | 342/175 |
| 2007/0040735 | A1 * | 2/2007 | Matsuo et al. | 342/175 |
| 2009/0079648 | A1 * | 3/2009 | Matsuo et al. | 343/771 |
| 2010/0245155 | A1 * | 9/2010 | Miyazato et al. | 342/104 |
| 2010/0245204 | A1 * | 9/2010 | Lee et al. | 343/860 |
| 2011/0025550 | A1 * | 2/2011 | Sagala et al. | 342/104 |

FOREIGN PATENT DOCUMENTS

| | | |
|---|---|---|
| JP | 2005-102024 | 4/2005 |
| JP | 2008-160785 | 7/2008 |

OTHER PUBLICATIONS

Korean language office action dated Mar. 8, 2013 and its English language translation issued in corresponding Korean application 20117025284.

Japanese language International Preliminary Report on Patentability dated Oct. 13, 2011 and its English language translation for corresponding PCT application PCT/2010/055968.

* cited by examiner

WAVEGUIDE STRUCTURE, HIGH FREQUENCY MODULE INCLUDING WAVEGUIDE STRUCTURE, AND RADAR APPARATUS

CROSS-REFERENCE TO THE RELATED APPLICATIONS

The present application is a national stage of international application No. PCT/JP2010/055968, filed on Mar. 31, 2010, and claims the benefit of priority under 35 USC 119 to Japanese Patent Application No. 2009-088205, filed on Mar. 31, 2009, the entire contents of which are incorporated herein by reference.

TECHNICAL FIELD

The present invention relates to a waveguide structure, a high frequency module including the waveguide structure, and a radar apparatus.

BACKGROUND ART

In recent years, research and development work has been briskly carried out on wireless communication technologies that utilize millimeter waves of frequencies greater than or equal to 30 GHz as high frequency signals. The wireless communication technologies utilizing millimeter waves as high frequency signals have been adopted for data communications and radars. High frequency substrates for use in wireless communications are required to have excellent transmission characteristics.

As typical transmission lines for transmitting high frequency signals such as millimeter waves, there is known a laminated waveguide in which a pseudo waveguide is formed of through conductors and electrically conductive layers in a multilayer circuit board. When it is desired to construct the laminated waveguide at a high level of integration in area, there may arise a need to turn the direction of transmission of high frequency signals from a planar direction to a thickness-wise direction. However, if the transmission direction in the laminated waveguide is turned to the thickness-wise direction, reflection of high frequency signals will take place at the turn of transmission direction, thus causing significant transmission loss. As a result, the transmission characteristics of the laminated waveguide may be deteriorated considerably.

Where transmission lines employing a rectangular waveguide are concerned, in Japanese Unexamined Patent Publication JP-A 9-199901 (1997), there is disclosed a technology of imparting a turned-back configuration to a transmission line by using a folded-waveguide. However, even if this folded-waveguide technology is applied to formation of a laminated waveguide, considerable deterioration in transmission characteristics of the laminated waveguide is inevitable.

An object of the invention is to provide a waveguide structure having excellent transmission characteristics, and a high frequency module including the waveguide structure, and a radar apparatus.

SUMMARY OF INVENTION

A waveguide structure according to the invention comprises a first waveguide and a mode conversion portion. The first waveguide transmits, in its interior, a high frequency signal in TE10 mode along a first direction. The mode conversion portion is configured to make electromagnetic coupling with the first waveguide. The mode conversion portion effects conversion from TE10 mode to TM11 mode on the high frequency signal propagating through the interior of the first waveguide. The mode conversion portion transmits the high frequency signal in a second direction perpendicular to the first direction. According to the waveguide structure pursuant to the invention, it is possible to attain excellent transmission characteristics of high frequency signals.

A high frequency module and a radar apparatus according to the invention comprise the above mentioned waveguide structure. According to the high frequency module and a radar apparatus pursuant to the invention, it is possible to attain excellent transmission characteristics of high frequency signals.

DESCRIPTION OF EMBODIMENTS

Figure 1:
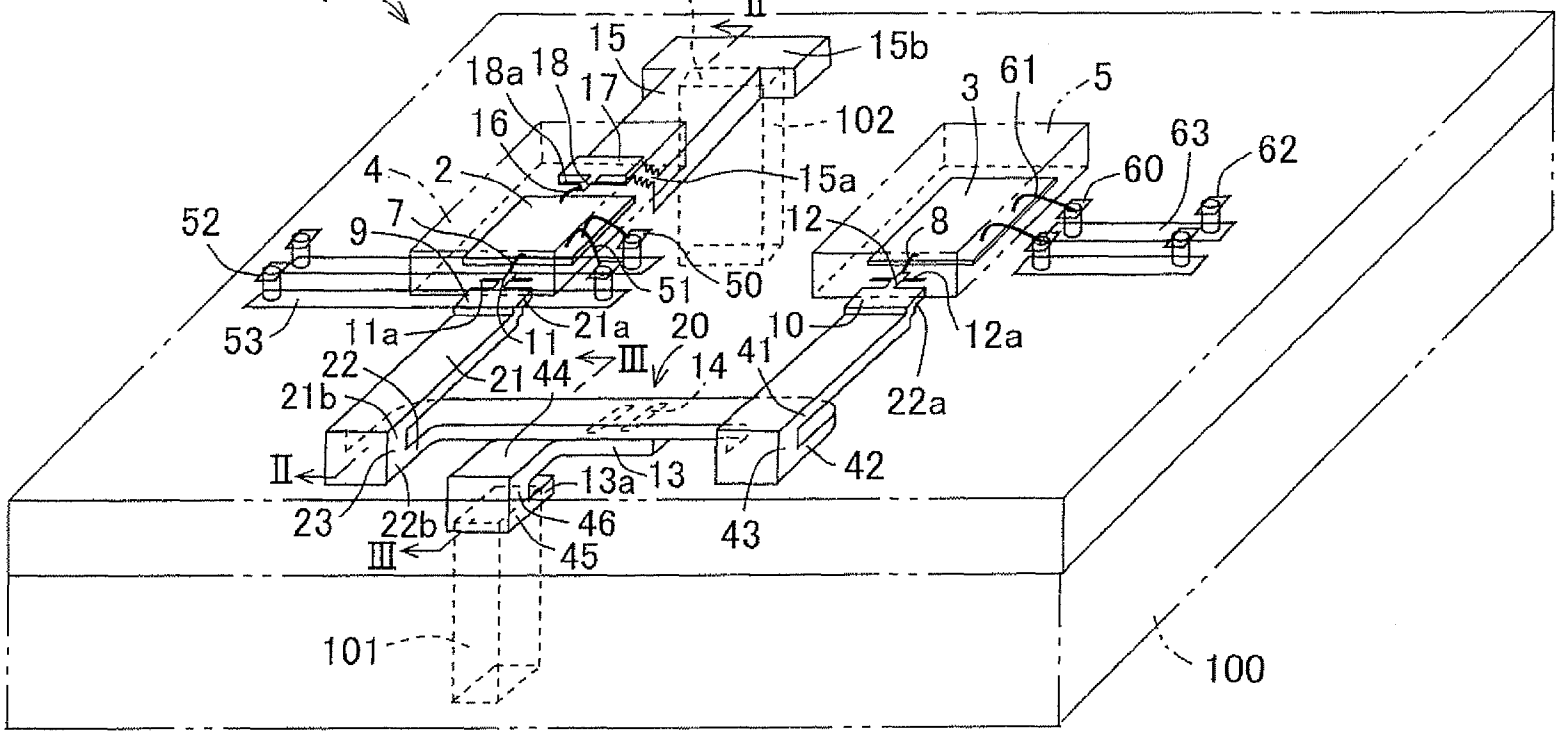
FIG. 1 is a perspective view showing the configuration of a high frequency substrate 1 in accordance with one embodiment of the invention.
Figure 2:
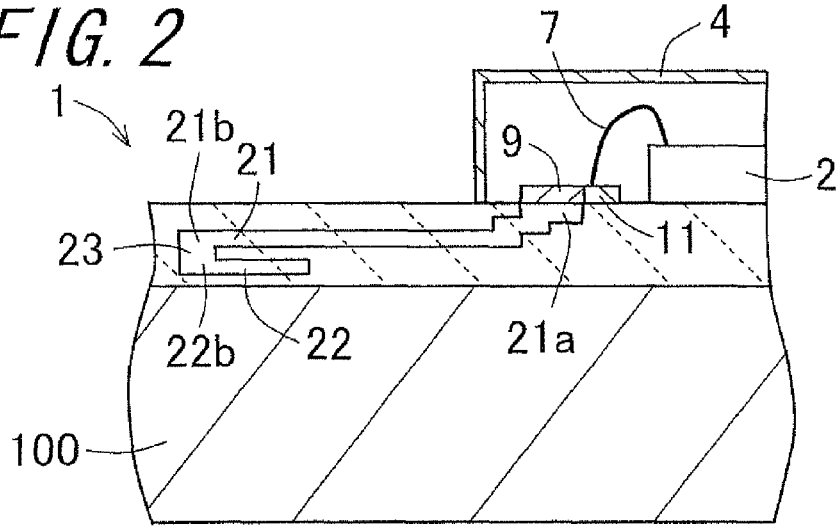
FIG. 2 is a sectional view in a state of being taken along the line II-II shown in FIG. 1.
Figure 3:
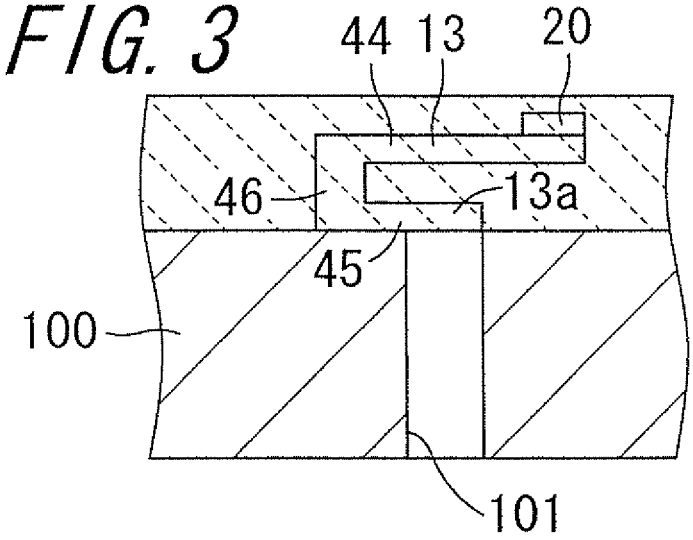
FIG. 3 is a sectional view in a state of being taken along the line III-III shown in FIG. 1.

Hereinafter, preferred embodiments of the invention will be described in detail with reference to the drawings. FIG. 1 is a perspective view showing the configuration of a high frequency substrate 1 in accordance with one embodiment of a waveguide structure of the invention. In FIG. 1, a part of the internal configuration of the high frequency substrate 1 and the interior of a protector are indicated by solid lines. FIG. 2 is a sectional view in a state of being taken along the line II-II shown in FIG. 1. FIG. 3 is a sectional view in a state of being taken along the line III-III shown in FIG. 1.

On a main surface of the high frequency substrate 1 is mounted at least one high frequency element, thereby constituting a high frequency module. In this embodiment, a MMIC (Monolithic Microwave Integrated Circuits) is adopted for use as the high frequency element. A receiving MMIC 2 and a transmitting MMIC 3 are mounted on the main surface of the high frequency substrate 1. The main surface of the high frequency substrate 1 is defined as a first main surface in the embodiment. Protectors 4 and 5 provide protection for the receiving MMIC 2 and the transmitting MMIC 3, respectively. The protectors 4 and 5 are placed on the first main surface of the high frequency substrate 1 so as to accommodate the receiving MMIC 2 and the transmitting MMIC 3, respectively, in a housing space surrounded by the protector 4, 5 and the first main surface of the high frequency substrate 1.

While the high frequency module of this embodiment bears two MMICs thereon, the number of MMICs may be one and may be three or more. Moreover, separate receiving and transmitting MMICs do not necessarily have to be used, and thus a dual-purpose transmitting/receiving MMIC can be used instead.

The high frequency substrate 1 is placed on an antenna board 100. A surface of the high frequency substrate that placed on the antenna board 100 is another main surface pairing off with the first main surface on which are mounted the receiving MMIC 2 and the transmitting MMIC 3. This opposite main surface is defined as a second main surface in the embodiment.

The receiving MMIC 2 and the transmitting MMIC 3 are electrically connected to each other by a laminated waveguide. The laminated waveguide is defined as a connection waveguide 20 in the embodiment. In the embodiment, the connection waveguide 20 comprises two laminated waveguides that lie over one another in the direction of thickness of the high frequency substrate 1. The connection waveguide 20 is so configured that the two laminated waveguides are, at their ends, electromagnetically coupled to each other. When configured to provide electromagnetic coupling between the ends of the two laminated waveguides, the connection waveguide 20 takes on a turned-back structure obtained by turning the two turned laminated waveguides. In the connection waveguide 20, one of the two laminated waveguides that is situated close to the first main surface is defined as an upper waveguide 21, whereas the other situated close to the second main surface is defined as a lower waveguide 22. As used herein, "electromagnetic coupling" refers to a state where high frequency signals are electromagnetically coupled between the two waveguides through an electromagnetic field resulting from transmission of the high frequency signals.

One end 21*a* of the upper waveguide 21 is electromagnetically coupled to the receiving MMIC 2. One end 22*a* of the lower waveguide 22 is electromagnetically coupled to the transmitting MMIC 3. The other end 21*b* of the upper waveguide 21 and the other end 22*b* of the lower waveguide 22 are electromagnetically coupled to each other via a mode conversion portion 23.

In the vicinity of the mode conversion portion 23, a high frequency signal propagating through the upper waveguide 21 and a high frequency signal propagating through the lower waveguide 22 are transmitted in opposite directions and in parallel with each other. A high frequency signal outputted from the transmitting MMIC 3 is firstly transmitted from one end 22*a* of the lower waveguide 22 to the other end 22*b* thereof. The high frequency signal having reached the other end 22*b* is transmitted, through the mode conversion portion 23, to the other end 21*b* of the upper waveguide 21 and from there to one end 21*a* thereof. The high frequency signal having reached one end 21*a* is inputted to the receiving MMIC 2. At this time, in the lower waveguide 22, the high frequency signal is transmitted in TE10 mode. The high frequency signal is then subjected to mode conversion from TE10 mode to TM11 mode in the mode conversion portion 23, and is transmitted through the mode conversion portion 23. Next, the high frequency signal is subjected to mode conversion once again from TM11 mode to TE10 mode, and is then transmitted through the upper waveguide 21. Transmission mode of the high frequency signal propagating through the upper waveguide 21 and the high frequency signal propagating through the lower waveguide 22 is TE10 mode. In addition, in the mode conversion portion 23, the high frequency signal is transmitted in TM11 mode after mode conversion.

The details of configurations of the upper waveguide 21, the lower waveguide 22, and the mode conversion portion 23 will hereafter be described. The laminated waveguide is constructed by arranging two conductive layers and a through conductor group for providing electrical connection between the conductive layers so as to surround dielectric layers. In lines for high frequency signal transmission, the laminated waveguide is so designed that a high frequency signal is transmitted through a transmission space surrounded by the conductors. In the laminated waveguide, a dielectric body serves as a transmission path.

The connection waveguide 20 and the receiving MMIC 2 are connected to each other via a bonding wire 7 and a coupling portion 9. One end of the bonding wire 7 is connected to a connection pad (not shown) of the receiving MMIC 2. The other end of the bonding wire 7 is connected to the coupling portion 9. The coupling portion 9 is configured to make electromagnetic coupling with the connection waveguide 20 at one end 21*a* of the upper waveguide 21.

The bonding wire 7 and the coupling portion 9 may be connected to each other directly. The bonding wire 7 and the coupling portion 9 may be connected through a microstrip line 11 as in the embodiment. Moreover, it is preferable to dispose a stub 11*a* for impedance matching in the microstrip line 11.

Connection between the connection waveguide 20 and the transmitting MMIC 3 is made via a bonding wire 8 and a coupling portion 10. One end of the bonding wire 8 is connected to a connection pad (not shown) of the transmitting MMIC 3. The other end of the bonding wire 8 is connected to the coupling portion 10. The coupling portion 10 is configured to make electromagnetic coupling with the connection waveguide 20 at one end 22*a* of the lower waveguide 22.

The bonding wire 8 and the coupling portion 10 may be connected to each other directly. The boding wire 8 and the coupling portion 10 may be connected to through a microstrip line 12. It is preferable to dispose a stub 12*a* for impedance matching in the microstrip line 12.

The connection waveguide 20 is configured to make electromagnetic coupling with a laminated waveguide via a slot 14 formed in the lower waveguide 22. The laminated waveguide is connected to a transmission port disposed on the back surface of the high frequency substrate 1. The laminated waveguide is defined as a transmission waveguide 13 in the embodiment. The transmission waveguide 13 has a transmission port 13*a*. The transmission waveguide 13 is configured to make electromagnetic coupling with one end of a transmission waveguide 101 of the antenna board 100. The antenna board 100 has a through-hole passing therethrough in its thickness-wise direction. The through-hole serves as a hollow waveguide. The hollow waveguide is defined as the transmission waveguide 101 in the embodiment. The other end of the transmission waveguide 101 is opened at the back surface of the antenna board 100, thereby forming an opening which serves as a slot antenna. The slot antenna radiates a high frequency signal of a specific frequency according to the dimension of the opening.

Thus, a high frequency signal outputted from the transmitting MMIC 3 is firstly transmitted through the connection waveguide 20. Then, a part of the high frequency signal propagating through the connection waveguide 20 is transmitted, through the slot 14 of the lower waveguide 22, to the transmission waveguide 13. The high frequency signal propagating through the transmission waveguide 13 is directed to the transmission port 13*a*, and is then outputted therefrom. The high frequency signal outputted from the transmission port 13*a* is transmitted through the transmission waveguide 101 of the antenna board 100, and is then radiated from the slot antenna of the transmission waveguide 101. In this way, the high frequency substrate 1 mounted the transmitting MMIC 3 pairs up with the antenna board 100 to function as a transmitter. While, in the embodiment, the high frequency substrate 1 and the antenna board 100 are constructed as separate components, the boards may be formed integrally with each other in a single-piece form.

A part of the high frequency signal outputted from the transmitting MMIC 3 is transmitted to the transmission waveguide 13. Moreover, the rest of the high frequency signal is transmitted, through the upper waveguide 21, to the receiving MMIC 2. The receiving MMIC 2 is configured to make electromagnetic coupling with the connection waveguide 20. The receiving MMIC 2 is also configured to make electromagnetic coupling with a laminated waveguide for transmitting a received high frequency signal. The laminated waveguide is defined as a reception waveguide 15 in the embodiment.

The receiving MMIC 2 and the reception waveguide 15 are so configured as to be electromagnetically coupled to each other via a bonding wire 16 and a coupling portion 17. One end of the bonding wire 16 is connected to a connection pad (not shown) of the receiving MMIC 2. The other end of the bonding wire 16 is connected to the coupling portion 17. The coupling portion 17 is connected to the reception waveguide 15 at one end 15*a* of the reception waveguide 15.

The bonding wire 16 and the coupling portion 17 may be connected to each other directly. The bonding wire 16 and the coupling portion 17 may be connected through a microstrip line 18. Moreover, it is preferable to dispose a stub 18*a* for impedance matching in the microstrip line 18.

The reception waveguide 15 has a reception port 15*c*. The reception waveguide 15 is configured to make electromagnetic coupling with one end of a reception waveguide 102 of the antenna board 100. The antenna board 100 has a through-hole passing completely therethrough in its thickness-wise direction. The through-hole serves as a hollow waveguide. The hollow waveguide is defined as the reception waveguide 102 in the embodiment. The other end of the reception waveguide 102 is opened at the back surface of the antenna board 100, thereby forming an opening which serves as a slot antenna. The slot antenna receives a high frequency signal of a specific frequency according to the dimension of the opening.

Thus, a high frequency signal received by the slot antenna of the reception waveguide 102 is firstly transmitted through the reception waveguide 102 of the antenna board 100. Then, the high frequency signal propagating through the reception waveguide 102 is transmitted, through the reception port 15*c*, to the reception waveguide 15. The high frequency signal propagating through the reception waveguide 15 passes through the coupling portion 17 and the bonding wire 16 to be inputted to the receiving MMIC 2. In this way, the high frequency substrate 1 mounting the receiving MMIC 2 pairs up with the antenna board 100 to function as a receiver.

The protectors 4 and 5 accommodate the high frequency element, the coupling portion, and the connecting body for providing connection between them in its housing space for protection. The area of the housing space corresponds to a region of the first main surface of the high frequency substrate 1 which places a single semiconductor device, a coupling portion which is connected, to the semiconductor device, and a connecting body for providing connection between them. Moreover, the height of the housing space corresponds to the height of the protector.

The protectors 4 and 5 provide physical protection for the receiving MMIC 2 and the transmitting MMIC 3, respectively. In the embodiment, the protectors 4 and 5 reduce entry of an external electromagnetic wave into a signal line as noise. Also, the protectors 4 and 5 reduce radiation of an electromagnetic wave from the receiving MMIC 2 and the transmitting MMIC 3 to the outside. Hence, in the embodiment, the protectors 4 and 5 reduce influence of electromagnetic waves radiated from various components on one another. The protectors 4 and 5 are preferably made of metal such as aluminum. The use of a metallic enclosure made of metal as the protectors 4 and 5 makes it possible to afford higher electromagnetic-wave shielding capability, as well as to afford higher thermal conductivity for enhanced heat dissipation capability. Moreover, the protectors 4 and 5 are not limited to the metallic enclosure made of metal, but may be of a resin enclosure made of resin or a ceramic enclosure made of ceramics. In the case of employing the resin enclosure or ceramic enclosure as the protector, it is advisable that the protector is internally plated or internally metallized in the interest of enhancement in electromagnetic-wave shielding capability. The plating or metallizing does not necessarily have to be performed on the entire inner surface of the protector, but may be performed on only a specific area thereof where it is desired to enhance electromagnetic-wave shielding capability.

In the embodiment, the protectors 4 and 5 are so respectively shaped as to provide a housing space therein. However, the protector is not so limited in shape. but the protector may have any given shape so long as it is able to protect the semiconductor device and the coupling portion. For example, in a case where the high frequency substrate is formed with a recess for accommodating the semiconductor device, the protector may be a flat lid configured to cover the recess. That is, in the case where the high frequency substrate is formed with a recess, even the protector itself made of a flat plate devoid of a housing space is able to serve as a member for protection.

The high frequency substrate 1 is so configured that the high frequency element, such as the receiving MMIC 2 and the transmitting MMIC 3, is electromagnetically coupled to the laminated waveguide 15, 20. The connection between the receiving MMIC 2 and the transmitting MMIC 3 is established by the connection waveguide 20 which is a laminated waveguide formed within the high frequency substrate 1. Therefore, in the high frequency substrate 1, the parts to be protected by the protectors 4 and 5 include the MMICs 2 and 3, the bonding wires 7, 8 and 16, the coupling portions 9, 10 and 17, and the microstrip lines 11, 12 and 18.

In the high frequency substrate 1, a region which is to be protected by the protectors 4 and 5 can be divided into small sections. Thus, in the embodiment, the high frequency substrate 1 can be provided with the protectors 4 and 5, respectively, for accommodating one semiconductor device in one housing space. For example, in the embodiment, inside a housing space formed by one protector 4 are accommodated one receiving MMIC 2 and the coupling portions 9 and 17. On the other hand, inside a housing space formed by one protector 5 are accommodated one transmitting MMIC 3 and one coupling portion 10.

That is, in the high frequency substrate 1, since such a protector as may accommodate one high frequency element in its housing space can be employed, it is possible to achieve separation of high frequency signals radiated from a plurality of high frequency elements. In the case of mounting the receiving MMIC 2 capable of detecting a change of a high frequency signal outputted from the transmitting MMIC 3 in the high frequency substrate 1 as in the embodiment, a greater degree of isolation can be attained.

Moreover, in the high frequency substrate 1, it is possible to employ a protector whose housing space is far smaller than that of a protector configured to accommodate a plurality of high frequency elements. Accordingly, the high frequency substrate 1 is capable of reducing oscillation of an electromagnetic wave radiated from a high frequency element in the housing space.

Moreover, in the embodiment, the bonding wire and the microstrip line are used as the connecting body for providing electrical connection between the MMIC and the coupling portion leading to the laminated waveguide. However, neither the bonding wire nor the microstrip line is an essential constituent for electrical connection between the MMIC and the coupling portion. For example, the bonding wire may be connected directly from the connection pad of the MMIC to the coupling portion. In another alternative, instead of wire bonding, a metal bump, an anisotropic conductive material, a conductive adhesive, or a resin mixed with a conductive material can be employed as the connecting body for providing connection between the MMIC and the coupling portion. That is, the MMIC may be connected to the coupling portion by means of flip-chip bonding.

Further, in the embodiment, the connection waveguide 20 having a turned-back structure provides electrical connection between the MMIC 2 and the MMIC 3 in the high frequency substrate 1. In the high frequency substrate 1, the proportion in area of the connection waveguide 20 can be reduced, with consequent miniaturization of the high frequency substrate 1. In order to obtain the turned-back structure, the connection waveguide 20 has the mode conversion portion 23. In the mode conversion portion 23, the high frequency signal propagating through the connection waveguide 20 is subjected to transmission-mode conversion from TE10 mode to TM11 mode. By virtue of the transmission-mode conversion, in the mode conversion portion 23, reflection of high frequency signals can be reduced, thereby suppressing transmission loss. As a result, the connection waveguide 20 exhibits excellent transmission characteristics.

In the embodiment, the high frequency substrate 1 adopts a turned-back structure also for a part of the connection waveguide 20 extending from the slot 14 to the MMIC 3. This turned-back structure comprises an upper waveguide 41, a lower waveguide 42, and a mode conversion portion 43. Moreover, in the high frequency substrate 1, a turned-back structure is adopted also for the transmission waveguide 13. The turned-back structure of the transmission waveguide 13 comprises an upper waveguide 44, a lower waveguide 45, and a mode conversion portion 46. Thus, in the high frequency substrate 1, a turned-back structure having a mode conversion portion is adopted for various internally-mounted laminated waveguides. In this way, in the high frequency substrate 1, the proportion in area of the laminated waveguide can be reduced even further.

Figure 4A:
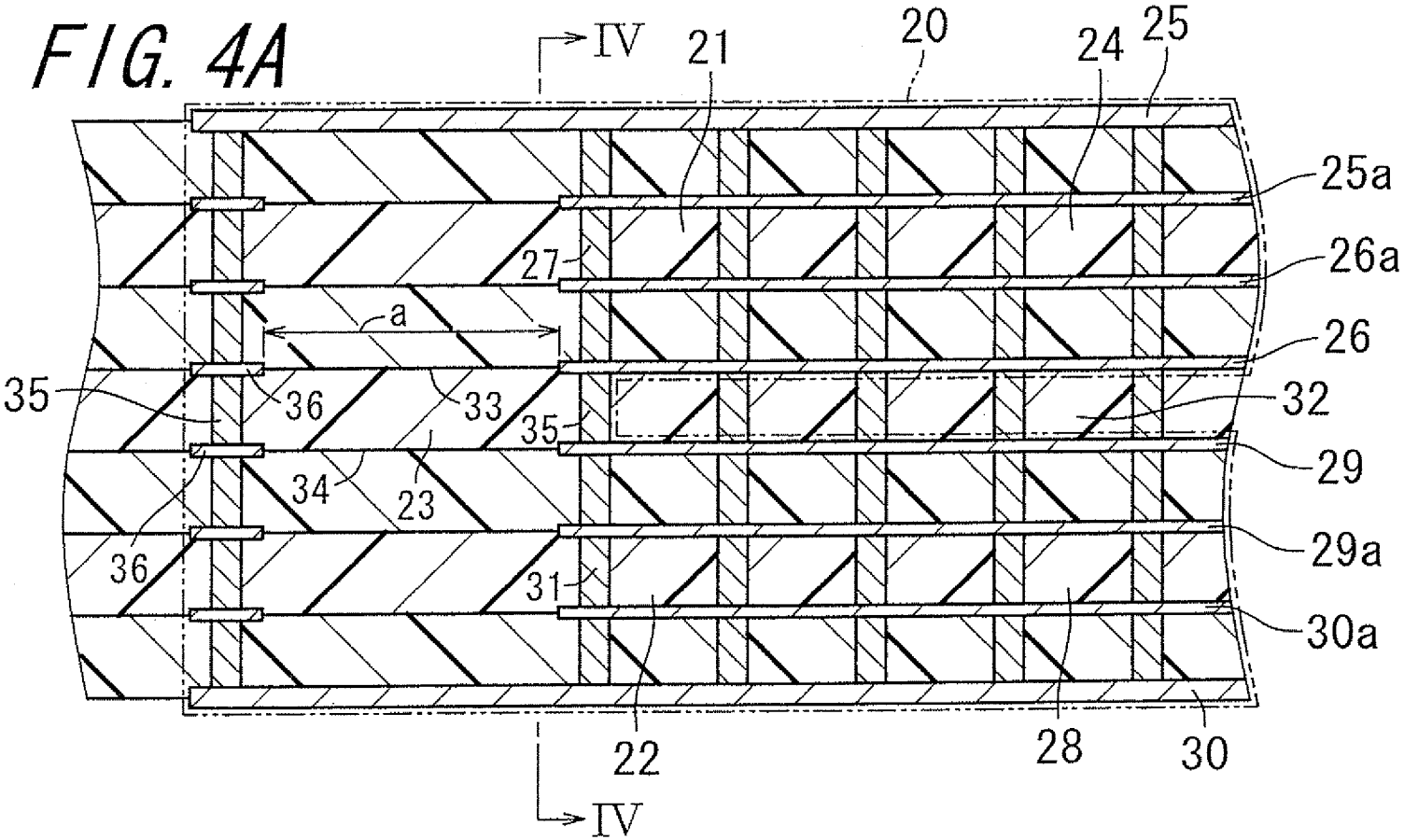
FIG. 4A is a perspective view showing the configuration of a connection waveguide 20.
Figure 4B:
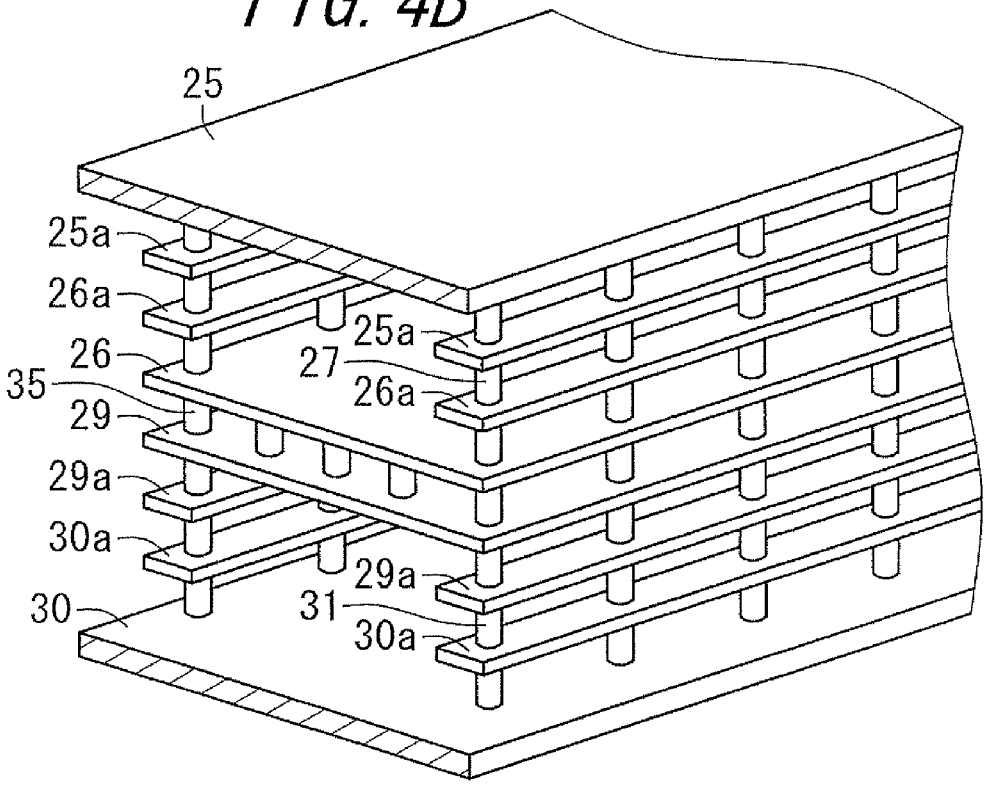
FIG. 4B is a perspective view of the connection waveguide 20 in a state of being taken along the line IV-IV shown in FIG. 4A.

FIG. 4A is a perspective view showing the configuration of the connection waveguide 20. FIG. 4B is a perspective view of the connection waveguide 20 in a state of being taken along the line IV-IV shown in FIG. 4A.

The upper waveguide 21 comprises a first dielectric layer 24, a pair of main conductive layers 25 and 26, and a through conductor group 27. The pair of main conductive layers 25 and 26 are so arranged as to sandwich the first dielectric layer 24 between them. In the pair of main conductive layers 25 and 26, the main conductive layer 25 is situated on the first main surface side of the high frequency substrate 1, whereas the main conductive layer 26 is situated on the second main surface side of the high frequency substrate 1. The through conductor group 27 provides electrical connection between the pair of main conductive layers 25 and 26. The through conductor group 27 passes through the first dielectric layer 24 in its thickness-wise direction. The through conductor group 27 is formed of a plurality of through conductors.

Moreover, the lower waveguide 22 comprises a second dielectric layer 28, a pair of main conductive layers 29 and 30, and a through conductor group 31. The pair of main conductive layers 29 and 30 are so arranged as to sandwich the second dielectric layer 28 between them. In the pair of main conductive layers 29 and 30, the main conductive layer 29 is situated on the first main surface side of the high frequency substrate 1, whereas the main conductive layer 30 is situated on the second main surface side of the high frequency substrate 1. The through conductor group 31 provides electrical connection between the pair of main conductive layers 29 and 30. The through conductor group 31 passes through the first dielectric layer 24 in its thickness-wise direction. The through conductor group 31 is formed of a plurality of through conductors. While, in the embodiment, the through conductor groups 27 and 31 are each formed of a plurality of through conductors, they may be of a pair of through conductors composed of a plurality of through conductors that are integral with each other.

The upper waveguide 21 and the lower waveguide are of equal width as indicated by "a" in the direction of transmission of high frequency signals. The width in the transmission direction corresponds to the length in a widthwise direction perpendicular to the transmission direction.

The main conductive layer 26 of the upper waveguide 21 is disposed to face the main conductive layer 29 of the lower waveguide 22. The main conductive layer 26 is formed with a through-hole located at an end of the upper waveguide 21 so as to face the lower waveguide 22. The through-hole of the main conductive layer 26 functions as a slot 33 of the upper waveguide 21.

Moreover, the main conductive layer 29 is formed with a through-hole located at an end of the lower waveguide 22 so as to face the upper waveguide 21. The through-hole of the main conductive layer 29 functions as a slot 34 of the lower waveguide 22. The slot 34 is opposed to the slot 33. The slots 33 and 34 are electrically connected to each other by a through conductor group 35. The through conductor group 35 includes a plurality of through conductors. The plural through conductors are arranged around the through-hole functioning as the slots 33 and 34. The through conductor group 35 surrounds the through-hole. While, in the embodiment, the through conductor group 35 is formed of a plurality of through conductors, it may be of a single through conductor composed of a plurality of through conductors that are integral with each other.

Figure 5A:
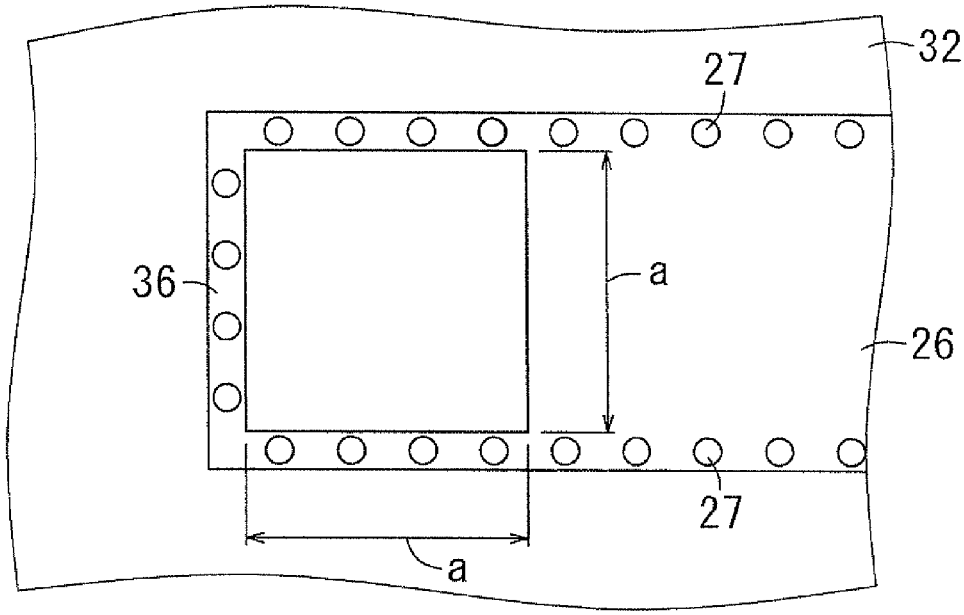
FIG. 5A is a plan view of an intermediate dielectric layer 32 when viewed from a first dielectric layer 24 side.
Figure 5B:
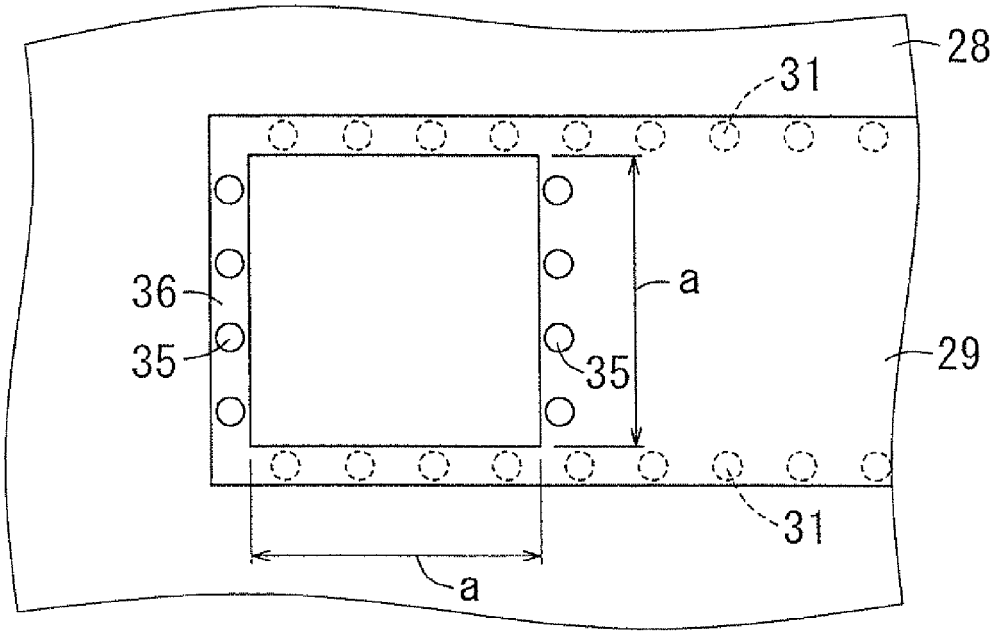
FIG. 5B is a plan view of the second dielectric layer 32 when viewed from the intermediate dielectric layer 24 side.

FIG. 5A is a plan view of an intermediate dielectric layer 32 when viewed from the first dielectric layer 24 side. FIG. 5B is a plan view of the second dielectric layer 28 when viewed from the intermediate dielectric layer 32 side.

The intermediate dielectric layer 32 is formed between the first dielectric layer 24 and the second dielectric layer 28. The through conductor group passes through the intermediate dielectric layer 32. In the intermediate dielectric layer 32, a region surrounded by the main conductive layer 26 of the upper waveguide 21, the main conductive layer 29 of the lower waveguide 22 and the through conductor group 35 is electromagnetically shielded from the surroundings. This region electromagnetically shielded from the surroundings is defined as a shielded region in the embodiment. The slots 33 and 34 each correspond to an end of the shielded region of the intermediate dielectric layer 32 in its thickness-wise direction. The shielded region of the intermediate dielectric layer 32 functions as the mode conversion portion 23. In the embodiment, the mode conversion portion 23 functions as a waveguide for allowing transmission of a high frequency signal between the slots 33 and 34.

The transmission mode of a high frequency signal propagating through the shielded region depends upon the size and shape of the slots 33 and 34. The slots 33 and 34 are so shaped as to set TM11 mode as the transmission mode. In the embodiment, the slots 33 and 34 are square-shaped. The length of one side of the square defining the slots 33 and 34 coincides with the width of the upper waveguide 21 as well as the lower waveguide 22, and is thus represented as "a".

In the embodiment, as the first dielectric layer and the second dielectric layer 28 as well, a layered structure composed of a stack of three dielectric layers of the same thickness is adopted. Moreover, in the embodiment, the thickness of the intermediate dielectric layer 32 corresponds to the thickness of a single layer of dielectric layers constituting each of the first and second dielectric layers 24 and 28. In other words, the thickness of the intermediate dielectric layer 32 is one-third the thickness of each of the first and second dielectric layers 24 and 28. Each of the first dielectric layer 24, the second dielectric layer 28 and the intermediate dielectric layer 32 may be formed by stacking a plurality of dielectric layers on top of one another. The through conductor group 27 and the through conductor group 31 pass through the stacked plural dielectric layers.

In this construction, the thickness of the intermediate dielectric layer 32 is so set that the sum of the length of the upper waveguide 21 in its thickness-wise direction, the length of the lower waveguide 22 in its thickness-wise direction and the length of the mode conversion portion 23 in its thickness-wise direction becomes greater than or equal to one-half of the in-waveguide wavelength of a propagating high frequency signal. By setting the thickness of the intermediate dielectric layer 32 in this way, a high frequency signal transmitted in TE10 mode from the upper waveguide 21 or the lower waveguide 22 is subjected to mode conversion in the mode conversion portion 23 so that it can be transmitted henceforth in TM11 mode.

In the laminated waveguide, it is preferable that, in the through conductor groups 27 and 31, two in-line rows of through conductors arranged along the signal transmission direction are electrically connected to each other via a conductive layer. That is, in the embodiment, conductive layers are formed between a plurality of dielectric layers to establish electrical connection of the through conductors constituting the through conductor group on a row-by-row basis. The conductive layers for providing connection in the through conductor groups 27 and 31 are defined as secondary conductive layers 25*a*, 26*a*, 29*a* and 30*a*. The formation of the secondary conductive layers 25*a*, 26*a*, 29*a* and 30*a* makes it possible to cut off, of electromagnetic waves polarized in the widthwise direction, those having a frequency not less than a predetermined frequency.

Moreover, in the case of constituting the first dielectric layer 24, the second dielectric layer 28 and the intermediate dielectric layer 32 by stacking a plurality of dielectric layers on top of one another, the formation of the secondary conductive layers 25*a*, 26*a*, 29*a* and 30*a* helps minimize variability in manufacture such as stacking misalignment.

It is noted that, by adjusting the sum of the length of the upper waveguide 21 in its thickness-wise direction and the length of the lower waveguide 22 in its thickness-wise direction to be greater than or equal to one-half of the in-waveguide wavelength of a propagating high frequency signal, it is possible to omit the intermediate dielectric layer 32. At this time, it is advisable that the main conductive layer 26 constituting the first dielectric layer 24 and the main conductive layer 29 constituting the second dielectric layer 28 are formed integrally to configure a single conductive layer. When the main conductive layers are formed integrally with each other in this way, then the opening of the slot functions as the mode conversion portion.

The reflection characteristics of the connection waveguide 20 have been investigated by running simulations with changes in the thickness of the intermediate dielectric layer 32. A simulation model under investigation is based on the construction as shown in FIGS. 4A and 4B, wherein the thickness of the first dielectric layer 24 as well as the second dielectric layer 28 is 150 μm; the length "a" of one side of the slot 33, 34 is 1030 (μm); and the frequency of a high frequency signal to be transmitted is 76.5 (GHz). The reflection, which took place at the end face of the upper waveguide 21 at the time a high frequency signal has been transmitted from the upper waveguide 21 to the mode conversion portion 23 and from there to the lower waveguide 22, was derived by calculation in terms of S parameter. In this way, evaluation of the reflection characteristics of the connection waveguide 20 has been carried out.

Figure 6:
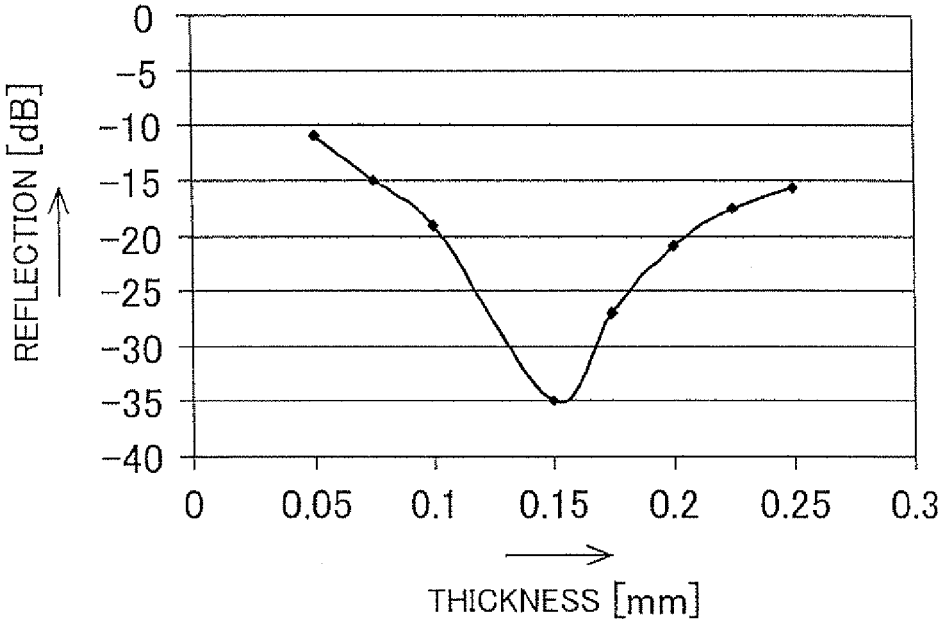
FIG. 6 is a graph showing reflection characteristics as observed with changes in thickness of the intermediate dielectric layer 32.

FIG. 6 is a graph showing reflection characteristics as observed with changes in thickness of the intermediate dielectric layer 32. The abscissa axis represents the thicknesses of the intermediate dielectric layer 32 (mm) and the ordinate axis represents reflection S11 (dB) in terms of S parameters.

Indices of the preferred level of high frequency signal reflection are given by values within a range −15 (dB) or less. As the result of the simulations, it has been found desirable to adjust the thickness of the intermediate dielectric layer 32 to fall in the range of from 0.075 to 0.25 (mm).

As described heretofore, according to the embodiment, in the upper waveguide 21 and the lower waveguide 22, signal transmission can be effected in TE10 mode, whereas, in the mode conversion portion 23, signal transmission can be effected in TE11 mode. In the high frequency substrate, in contrast to the case of using a mixed mode of TE10 and TM11, it is possible to achieve reduction in transmission loss induced by reflection. That is, the high frequency substrate succeeds in providing enhanced transmission characteristics.

A driving bias voltage is supplied to the MMICs 2 and 3 in the following manner.

A connection pad of the MMIC and a bias supply pad formed on the first main surface of the high frequency substrate 1 are connected to each other by means of wire-bonding connection or flip-chip connection. The bias supply pad and an external connection pad formed on the first main surface of the high frequency substrate 1 are connected to each other by bias supply line formed within the high frequency substrate 1. By the connection of the bias voltage supply source with the external connection pad, a driving bias voltage can be supplied to the MMIC.

In the embodiment, the connection pad of the receiving MMIC 2 and a bias supply pad 50 formed on the first main surface of the high frequency substrate 1 are connected to each other by a bonding wire 51. The bias supply pad 50 and an external connection pad 52 formed on the first main surface of the high frequency substrate 1 are connected to each other by bias supply line 53 formed within the high frequency substrate 1. Moreover, the connection pad of the transmitting MMIC 3 and a bias supply pad 60 formed on the first main surface of the high frequency substrate 1 are connected to each other by a bonding wire 61. The bias supply pad 60 and an external connection pad 62 formed on the first main surface of the high frequency substrate 1 are connected to each other by bias supply line 63 formed within the high frequency substrate 1.

Moreover, in the foregoing embodiment, there is described the laminated waveguide employing the turned-back structure, expressed differently, the structure in which the upper waveguide and the lower waveguide are configured to effect signal transmission in opposite directions. However, an embodiment of the invention is not limited to the turned-back structure, and embodiments of the invention include a structure in which the upper waveguide and the lower waveguide are configured to effect signal transmission in the same direction.

Figure 7:
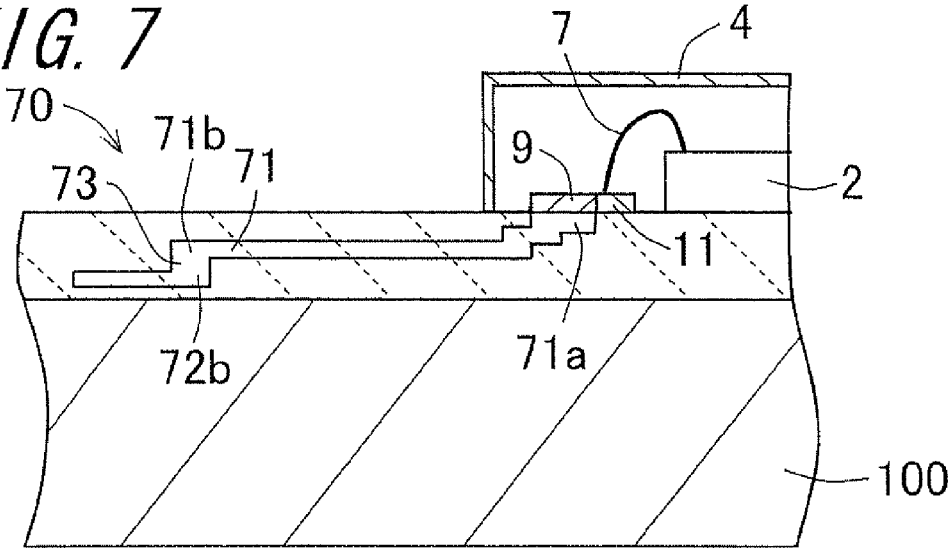
FIG. 7 is a sectional view schematically showing the structure of a high frequency substrate 70 in accordance with another embodiment of the invention.

FIG. 7 is a sectional view schematically showing the structure of a high frequency substrate 70 in accordance with another embodiment of the invention. The high frequency substrate of this embodiment is similar in structure to the preceding embodiment as shown for example in FIGS. 1 and 2, a difference being the placement of the lower waveguide. Accordingly, the components that play the same or corresponding roles as in the preceding embodiment of the high frequency substrate will be identified with the same reference symbols, and the descriptions thereof will be omitted.

In this construction, one end 71*a* of an upper waveguide 71 is electromagnetically coupled to the receiving MMIC 2. One end of a lower waveguide 72 is electromagnetically coupled to the transmitting MMIC. The other end 71*b* of the upper waveguide 71 and the other end 72*b* of the lower waveguide 72 are each electromagnetically coupled to a mode conversion portion 73. In the vicinity of the mode conversion portion 73, a high frequency signal propagating through the upper waveguide 71 and a high frequency signal propagating through the lower waveguide 72 are transmitted in the same direction and in parallel with each other.

In each of the upper waveguide 71 and the lower waveguide 72, a high frequency signal is transmitted in TE10 mode. The high frequency signal in TE10 mode is subjected to mode conversion into TM11 mode in the mode conversion portion 73 for further transmission. The direction of the high frequency signal propagating through the lower waveguide 72 is turned from a planar direction parallel with the main surface of the high frequency substrate 1 to a thickness-wise direction at the mode conversion portion 73. The high frequency signal having transmitted in TE11 mode through the mode conversion portion 73 is subjected to mode conversion into TE10 mode for transmission through the upper waveguide 71. The direction of the high frequency signal propagating through the mode conversion portion 73 is turned from the thickness-wise direction to the planar direction in the upper waveguide 71.

In such a transmission line in which the direction of high frequency signal transmission changes between the planar direction and the thickness-wise direction, the use of the mode conversion portion 73 according to the embodiment makes it possible to reduce reflection-induced transmission loss. In the embodiment, the reduction in transmission loss leads to excellent high frequency signal transmission characteristics.

Figure 8:
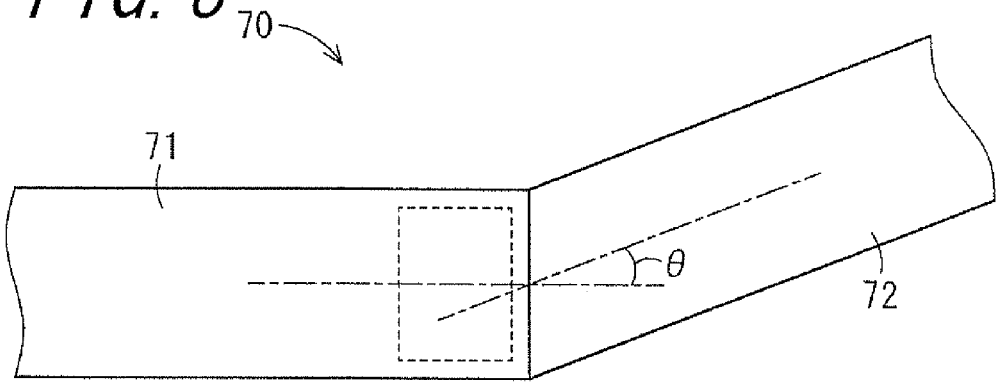
FIG. 8 is a schematic view of an upper waveguide and a lower waveguide of the high frequency substrate 70 when viewed in a plan view.

FIG. 8 is a schematic view of the upper waveguide 71 and the lower waveguide 72 of the high frequency substrate 70 when viewed in a plan view. In the high frequency substrate 1 when viewed in a plan view, an angle formed by the high frequency signal transmission direction in the upper waveguide 71 and the high frequency signal transmission direction in the lower waveguide 72 is assumed to be θ. That is, given the angle θ of 0 or 180 degrees, then a high frequency signal propagating through the upper waveguide 71 and a high frequency signal propagating through the lower waveguide 72 are transmitted in the same direction or in opposite directions and in parallel with each other. For example, the angle θ is preferably so set as to fulfill conditions of $0° \leq \theta \leq 45°$, $135° \leq \theta \leq 225°$, and $315° \leq \theta 360°$. When the angle θ falls within the above bounds, transmission loss that occurs depending on the angle can be reduced to a low of less than −3 dB. Accordingly, in the inner layers of the high frequency substrate 70, the design flexibility of the waveguide can be increased by an amount corresponding to the above allowable range of the angle θ.

Moreover, by way of still another embodiment, it is possible to employ two high frequency substrates. That is, a waveguide disposed in one of the high frequency substrates and a waveguide disposed in the other may be connected to each other via a mode conversion portion. In this case, the waveguide disposed in one high frequency substrate corresponds to the first waveguide, and the waveguide disposed in the other high frequency substrate corresponds to the second waveguide. The mode conversion portion may be formed in either high frequency substrate. Also, the mode conversion portion may be so configured that a part thereof is formed in one high frequency substrate and the rest is formed in the other high frequency substrate. The connection of the two high frequency substrates is accomplished in such a way that the two waveguides can be connected to each other via the mode conversion portion.

Figure 9:
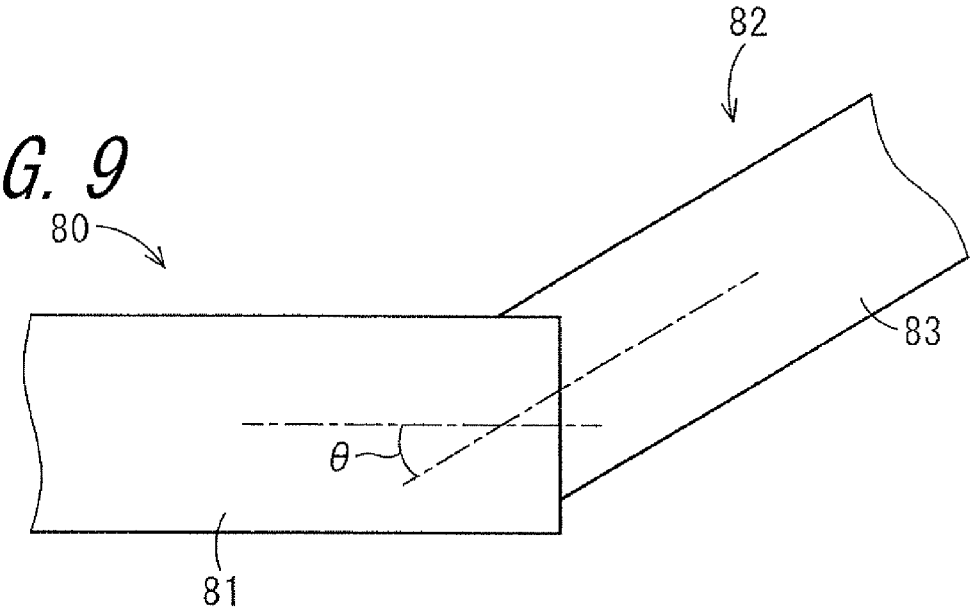
FIG. 9 is a schematic view of a connection structure of waveguides disposed in two high frequency substrates when viewed in a plan view.

FIG. 9 is a schematic view of the connection structure of waveguides disposed in two high frequency substrates when viewed in a plan view. A waveguide disposed in one high frequency substrate 80 is defined as a first waveguide 81, and a waveguide disposed in the other high frequency substrate 82 is defined as a second waveguide 83. An angle formed by the high frequency signal transmission direction in the first waveguide 81 and the high frequency signal transmission direction in the second waveguide 83 is assumed to be θ. For example, the angle θ is preferably so set as to fulfill conditions of $0° \leq \theta \leq 45°$, $135° \leq \theta \leq 225°$, and $315° \leq \theta 360°$.

During the bonding of the high frequency substrate 80 to the high frequency substrate 82 with use of a bonding member such as solder, there may be a case where bonding misalignment is caused by rotation of the substrates. However, even if bonding misalignment results from the rotation, so long as the bonding misalignment stays within the above limits of the angle θ, excellent transmission characteristics can be attained.

In addition, a transceiver and a radar apparatus which comprise the high frequency substrate 1 are implementable by way of still another embodiment of the invention.

Just as with the high frequency substrate 1 shown in FIG. 1, the transceiver is mounted with the receiving MMIC 2 and the transmitting MMIC 3. In the transceiver, the connection waveguide 20 serves as a branch for effecting branching of a high frequency signal outputted from the transmitting MMIC 3. The transceiver comprises the high frequency substrate 1 and the antenna board 100. The antenna board 100 includes the transmission waveguide 101 and the reception waveguide 102. In the transceiver, the receiving MMIC 2 has a built-in mixer that mixes the other one of high frequency signals obtained as the result of branching by the branch and a high frequency signal received at the receiving antenna to output an intermediate-frequency signal.

With the provision of the high frequency substrate 1, the transceiver is capable of reduction in reflection-induced transmission loss, with consequent enhancement in transmission characteristics. Also, the transceiver can be made compact yet afford excellent transmission-reception performance capability.

Moreover, the radar apparatus includes the transceiver and a detector configured to detect at least a distance to an object to be detected or relative velocity on the basis of the intermediate-frequency signal from the mixer. With the provision of the compact transceiver capable of delivering excellent transmission-reception performance, the radar apparatus can be made compact yet afford a greater degree of detection accuracy.

There is no particular limitation to the material used for the dielectric layer of the high frequency substrate having the foregoing structure so long as it does not hinder transmission of a high frequency signal in nature. From the standpoint of precision in forming a transmission line and easiness of manufacture, the dielectric layer is preferably made of ceramics.

For example, such a dielectric layer is produced through the following process steps. Firstly, organic solvent and solution medium are admixed in powder of a raw ceramic material to prepare a slurry. Examples of the ceramic material include glass ceramics, alumina ceramics, and aluminum nitride ceramics. Then, the slurry is shaped into sheets to obtain a plurality of ceramic green sheets. Examples of the sheet-forming method include a doctor blade technique and a calender roll technique. Next, the ceramic green sheets are subjected to stamping process to form via-holes. the via-holes is filled with a conductor paste. Moreover, various conductor patterns are printed onto the ceramic green sheets. The ceramic green sheets thereby processed are stacked on top of each other in layers. The stacked body of ceramic green sheets is fired to obtain a dielectric body. In the case of using glass ceramics, the firing is performed at a temperature in a range of 850 to 1000 (° C.). In the case of using alumina ceramics, the firing is performed at a temperature in a range of 1500 to 1700 (° C.). In the case of using aluminum nitride ceramics, the firing is performed at a temperature in a range of 1600 to 1900 (° C.).

Moreover, in forming various conductive layers including the pair of conductive layers, depending on the material used for the dielectric layer, the following conductor pastes are desirable for use. Where the dielectric layer is made of alumina ceramics, a suitable conductor paste is prepared by admixing an oxide, organic solvent and solution medium, and so forth in powder of metal such for example as tungsten or molybdenum. Examples of the oxide include alumina, silica, and magnesia. In the case of glass ceramics, for example, copper, gold, and silver are suitable for the metal powder. In the case of alumina ceramics and aluminum nitride ceramics, for example, tungsten and molybdenum are suitable for the metal powder. Such a conductor paste is printed onto the ceramic green sheet by means of thick-film printing method or otherwise. Following the printing, firing treatment is performed thereon at a temperature as high as about 1600 (° C.) in such a manner that the resultant layer has a thickness in a range of 10 to 15 (μm). It is noted that, in general, the main conductive layer has a thickness in a range of 5 to 50 (μm).

A resin material can be used for the dielectric layer of the circuit board. Examples of the resin material that can be used for the dielectric layer include PTET (Poly(TriEthylene Terephthalate)), liquid crystal polymer, fluorine resin, and glass matrix-containing fluorine resin or epoxy resin. As the glass matrix-containing epoxy resin, FR-4—(Flame Retardant type 4) material is particularly desirable. In addition, a mixed material in which ceramics and resin are mixed can also be used. In this case, the metal conductor for use may be formed, for example, by patterning of a bonded copper foil or copper plating film. Examples of the patterning include etching.

In resin substrates prepared as the dielectric layers, a through conductor group is formed of internally copper-plated through vias or buried vias. The opening of the mode conversion portion is created at a predetermined location in the resin substrate by means of drilling, laser, etching, or otherwise. The high frequency substrate can be formed by bonding together stacked resin substrates bearing various conductor patterns.

It should be understood that the embodiments as set forth hereinabove are considered in all respects as illustrative only and not restrictive, the scope of the invention being indicated by the appended claims rather than the foregoing description.

REFERENCE SIGNS LIST

1: High frequency substrate
2: Receiving MMIC
3: Transmitting MMIC
4, 5: Protectors
7, 8: Bonding wire
9, 10, 17: Coupling portion
13: Transmission waveguide
15: Reception waveguide
20: Connection waveguide
21: Upper waveguide
22: Lower waveguide
23: Mode conversion portion

The invention claimed is:

1. A waveguide structure, comprising:

a first waveguide configured to internally transmit a high frequency signal in TE10 mode along a first direction;

a mode conversion portion configured to electromagnetically couple with the first waveguide, to convert the high frequency signal from TE10 mode to TM11 mode, and to transmit the high frequency signal converted in a second direction perpendicular to the first direction; and a second waveguide configured to electromagnetically couple with the mode conversion portion, and to internally transmit the high frequency signal in the TE10 mode along a third direction perpendicular to the second direction, wherein the first waveguide comprises a first slot at an end thereof facing the second waveguide, the first slot having a square shape with a substantially same width as a width of the first waveguide, the second waveguide comprises a second slot at an end thereof facing the first waveguide so as to be opposed to the first slot, the second slot having a square shape with a substantially same width as a width of the second waveguide, the mode conversion portion is configured to further convert the high frequency signal from the TM11 mode to the TE10 mode, and to transmit the high frequency signal in the TE10 mode to the second waveguide, and a sum of a thickness of the mode conversion portion in the second direction, a length of the first waveguide in the second direction and a length of the second waveguide in the second direction is set to be greater than or equal to one-half of an in-waveguide wavelength of the high frequency signal.

2. The waveguide structure according to claim 1, wherein the first waveguide comprises a first dielectric layer, a pair of first main conductive layers which the first dielectric layer is sandwiched therebetween, and a first through conductor group electrically connecting the pair of first main conductive layers each other, the first slot is configured by a first through-hole formed in a square shape with a substantially same width as the width of the first waveguide, at an end of a first main conductive layer facing the second waveguide of the pair of first main conductive layers, the second waveguide comprises a second dielectric layer, a pair of second main conductive layers which the second dielectric layer is sandwiched therebetween, and a second through conductor group electrically connecting the pair of second main conductive layers each other, the second slot is configured by a second through-hole formed in a square shape with a substantially same width as the width of the second waveguide, at an end of a second main conductive layer facing the second waveguide and opposed to the first through-hole of the pair of second main conductive layers, and the mode conversion portion comprises an intermediate dielectric layer, and a through conductor group passing through the intermediate dielectric layer and arranged around the first through-hole and the second through-hole.

3. The waveguide structure according to claim 1, further comprising:

a first coupling portion which is configured to electromagnetically couple with the first waveguide and is connected to a first high frequency element.

4. The waveguide structure according to claim 1, wherein the second waveguide is configured to electromagnetically couple with a first antenna.

5. The waveguide structure according to claim 3, further comprising:

a second coupling portion which is configured to electromagnetically couple with the second waveguide and is connected to a second high frequency element.

6. The waveguide structure according to claim 5, further comprising a third waveguide configured to electromagnetically couple the second coupling portion with the second waveguide, wherein the second waveguide is configured to electromagnetically couple with a second antenna.

7. A high frequency module, comprising:

the waveguide structure according to claim 3; and a first high frequency element configured to electromagnetically couple with the first coupling portion.

8. A high frequency module, comprising:

the waveguide structure according to claim 5;

a first high frequency element configured to electromagnetically couple with the first coupling portion; and a second high frequency element configured to electromagnetically couple with the second coupling portion.

9. The high frequency module according to claim 8, further comprising:

a first protector configured to cover the first high frequency element, the first coupling portion and a first connecting member which electrically connects the first high frequency element and the first coupling portion; and a second protector configured to cover the second high frequency element, the second coupling portion and a second connecting member which electrically connects the second high frequency element and the second coupling portion.

10. A radar apparatus, comprising:

the high frequency module according to claim 8, including a transmitting antenna configured to transmit the high frequency signal and electromagnetically couple with the second waveguide, and a receiving antenna configured to receive the high frequency signal and electromagnetically couple with the second waveguide, wherein the first high frequency element comprises an output element configured to output the high frequency signal, the second waveguide comprises a branch configured to divide the high frequency signal outputted from the output element into a plurality of branched signals, and to output one of the plurality of branched signals to the transmitting antenna, and the second high frequency element comprises a mixer configured to mix the one of the plurality of branched signals and a received signal acquired by the receiving antenna to produce an intermediate-frequency signal, and to output the intermediate-frequency signal; and a detector configured to detect at least one of a distance and a relative velocity with respect to an object to be detected, based on the intermediate-frequency signal from the mixer.

11. The waveguide structure according to claim 1, wherein the thickness of the mode conversion portion in the second direction is about one-third of a thickness of each of the first waveguide and the second waveguide.

* * * * *